United States Patent [19]

Milia

[11] Patent Number: 4,497,432

[45] Date of Patent: Feb. 5, 1985

[54] DISPENSER PACKAGE ASSEMBLY

[75] Inventor: Frank Milia, Commack, N.Y.

[73] Assignee: Carlisle Laboratories, Inc., Inwood, N.Y.

[21] Appl. No.: 540,024

[22] Filed: Oct. 7, 1983

[51] Int. Cl.[3] ..... B65D 5/38; B65D 5/72

[52] U.S. Cl. ..... 229/17 B; 229/20

[58] Field of Search ..... 229/17 B, 11, 20, 23 BT, 229/41 B, 39 B; 206/44.12, 536; 221/305, 309, 310, 311; 312/42, 45

[56] References Cited

U.S. PATENT DOCUMENTS

| | | | |
|---|---|---|---|
| 781,527 | 1/1905 | Jeffers | 206/536 |
| 1,953,418 | 4/1934 | MacDonald | 229/11 X |
| 2,214,437 | 9/1940 | Punte et al. | 206/536 |
| 2,763,956 | 9/1956 | Olson | 43/55 |
| 2,917,162 | 12/1959 | Horland | 206/536 |
| 2,927,686 | 3/1960 | Blum | 206/536 |
| 3,111,223 | 11/1963 | Jacobi | 229/39 B X |
| 3,164,298 | 1/1965 | Repko | 229/17 B X |
| 3,326,433 | 6/1967 | Koch | 224/235 |
| 3,411,691 | 11/1968 | Whitaker et al. | 229/41 B X |
| 3,521,810 | 7/1970 | Boyer | 229/23 BT |
| 3,630,430 | 12/1971 | Struble | 229/41 B |
| 3,709,402 | 1/1973 | Templeton et al. | 229/11 X |
| 3,786,914 | 1/1974 | Beutler | 229/41 B X |
| 4,279,373 | 7/1981 | Montealegre | 229/11 |
| 4,392,605 | 7/1983 | Backman | 229/23 BT X |

FOREIGN PATENT DOCUMENTS

| | | | |
|---|---|---|---|
| 169760 | 12/1959 | Sweden | 229/37 R |
| 107331 | 6/1917 | United Kingdom | 229/11 |
| 110271 | 10/1917 | United Kingdom | 229/11 |

*Primary Examiner*—William Price
*Assistant Examiner*—Gary E. Elkins
*Attorney, Agent, or Firm*—Albert F. Kronman

[57] ABSTRACT

The dispenser package assembly having a hollow outer casing open at each end and an article receiving tray carried within the casing. The tray may be partially slipped out of the outer casing to expose one of the articles therein. Hinged corner portions at the top of the outer casing may be swung inwardly to retain the tray in its partially opened condition. The hinged corner portions may be restored to their original position when the tray is no longer in use, thereby enclosing the articles within the container.

7 Claims, 5 Drawing Figures

DISPENSER PACKAGE ASSEMBLY

BACKGROUND OF THE INVENTION

This invention relates to packages in which the package serves as a dispenser for the articles contained therein. Packaging of this type is most useful where a plurality of small articles are to be taken from the packaging one at a time during normal use without disturbing the remaining articles and making a single article available for ready removal. Packaging of the dispenser type is particularly useful for medical purposes where the user may wish to extract one of the articles while using his other hand for other purposes.

Prior art dispenser packages have been relatively complicated in structure and therefore expensive to manufacture. Others have required two hands for the removal of articles from the packaging. Still others have been made of materials which render them uneconomical.

Accordingly, it is an object of the present invention to provide a dispenser package assembly of simple and economical construction. Another object of the present invention is to provide a dispenser package assembly which will lend itself to single-hand use for removal of articles therefrom. A further object of the present invention is to provide a dispenser packaging assembly which may be used either in a vertical or horizontal position and which will remain in the dispensing mode between article removal operations. An object of the present invention is to provide an article dispenser package which will remain open during use and may be readily closed if so desired.

SUMMARY

A dispenser package assembly made in accordance with the present invention consists of an outer casing of somewhat trapazoidal shape, within which there is slidably received an article-retaining tray. Tabs are formed at the top rear of the outer casing by suitable scoring and embossing. The tabs initially are disposed in the plane of the back and sides of the outer casing and thereafter may be pressed inwardly to form a stop for a tray which is carried within the casing and which holds the articles within the package. Initially, the tray is disposed completely within the outer casing. When it is desired to have access to the articles within the package, the tray is slipped out of the casing through the bottom thereof a short distance and the tabs swung inwardly above the end of the tray within the casing. The package is then ready for use, since the tray will extend a short distance below the outer casing, exposing one of the articles contained therein.

BRIEF DESCRIPTION OF THE DRAWINGS

In the accompanying drawings, forming part hereof, similar elements have been given the same reference numerals, in which drawing.

DETAILED DESCRIPTION

Figure 1:
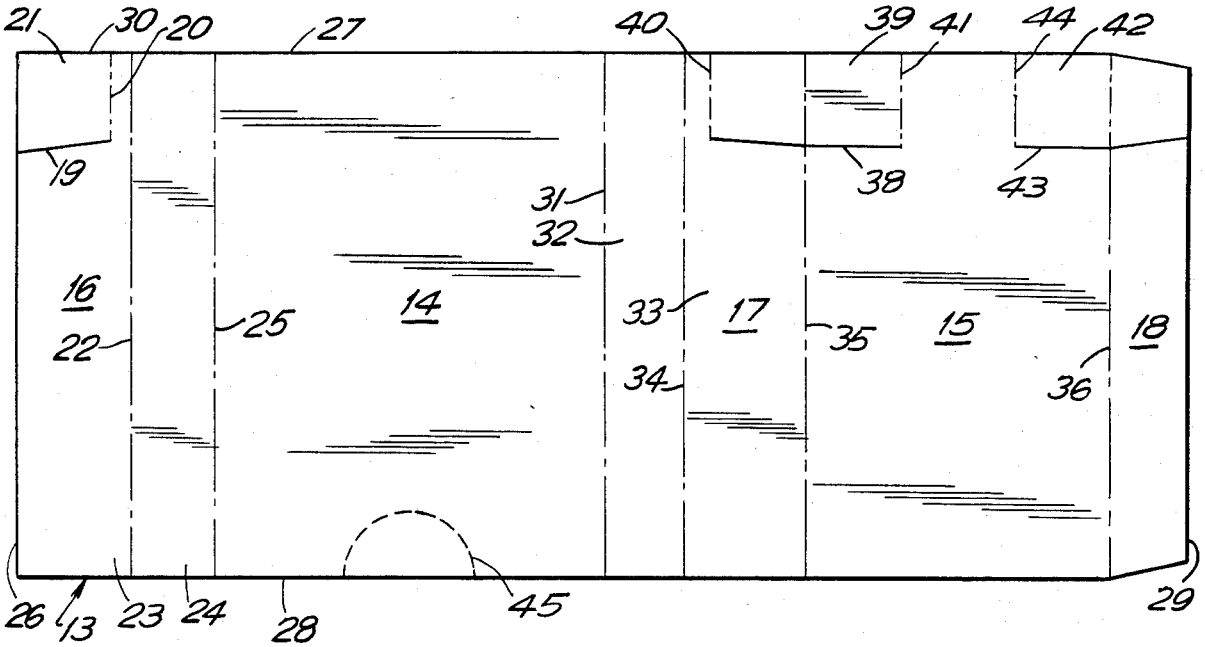
FIG. 1 is an elevational view of a blank suitable for forming the outer casing of a dispenser package made in accordance with the present invention.
Figure 2:
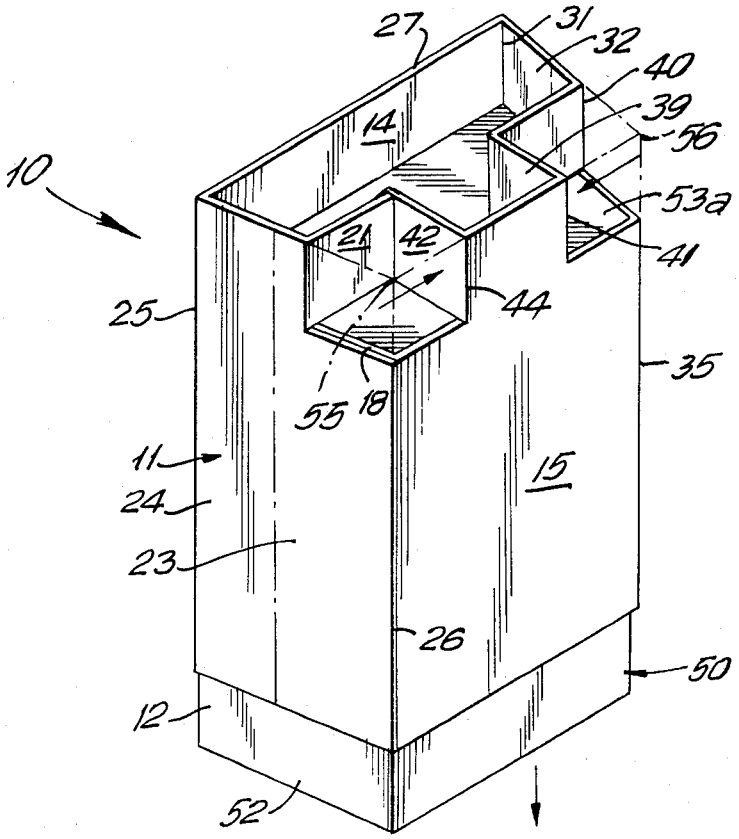
FIG. 2 is a somewhat isometric rear view of a complete package made in accordance with the present invention.

Referring to the drawings, 10 indicates a dispenser package assembly having an outer casing 11 and a tray 12 slidably received therein. The outer casing 11 is formed from a blank 13 (best shown in FIG. 1), which may be made of paper, cardboard, plastic, or any suitable inexpensive material. The blank 13 consists of a front panel 14, a rear panel 15, a first side panel 16, a second side panel 17 and a side flap 18; all of which may be integrally stamped from a single sheet of material.

The side flap 16 is scored as indicated at 19 along a slight angled line, spaced from its top margin 30 and embossed as indicated by the dot-dash line 20 to provide a tab 21 for a hereinafter more fully described purpose. The first side 16 is divided by a fold line 22 into a first section 23 and a second section 24. A second fold line 25, inwardly spaced from and parallel to the outer side margin 26 of the first side panel 16, extends from the top margin 27 to the bottom margin 28 of the blank 13. A second outer side margin 29 defines the periphery of the blank 13.

The first side panel 16 is connected to the front panel 14 along the second fold line 25, which is parallel to the first fold line 22 and spaced therefrom. The second fold line defines one side of the front panel 14. A third fold line 31, spaced from and parallel to fold line 25, is provided on the opposite side of the front panel 14.

The second side panel 17 is connected to the front panel 14 along the third fold line 31. The second side panel 17 is also divided into two sections 32, 33 by a fourth fold line 34.

A fifth fold line 35, spaced from and parrallel to the fourth fold line 34, is located along the intersection where the second side panel 17 meets the rear panel 15.

The opposite side of the rear panel 15 is integral with the side flap 18 along a sixth fold line 36. All of the fold lines 1–6 may be formed by embossing or in any other suitable manner and extend from the bottom margin to the top margin of the blank 13. It will be understood that when the blank 13 is folded upon the fold lines, the outer casing 11 will be a continuous enclosure, which is retained in place by gluing side flap 18 to the first side panel 16 as best shown at 37 in FIG. 5.

Figure 3:
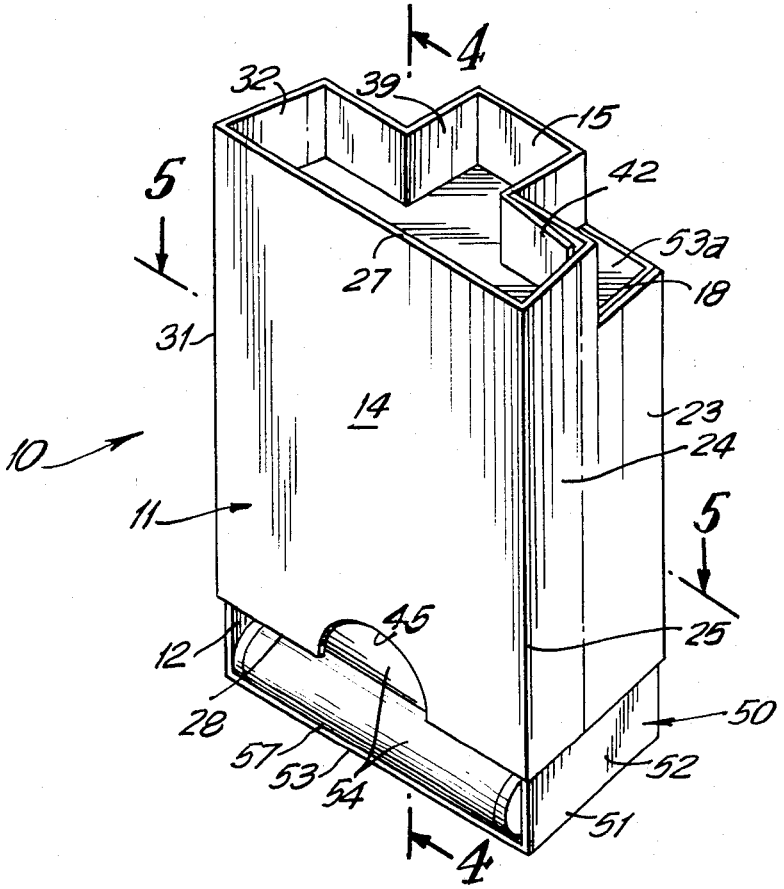
FIG. 3 is a somewhat isometric front view of the package shown in FIG. 2.

Referring to the blank in FIG. 1, it will be seen that the second side panel 17, and more specifically the fourth side section 33, and the rear panel 15 are scored along the line 38 which runs across the fold line 35. The line 38 is spaced from the top margin 27 of the blank a distance to define the bottom of a hinged tab 39. The hinged tab 39 is formed by spaced embossings 40, 41 at each end of the score 38, which embossings extend from the score to the top margin 27. A second hinged tab 42 is formed at the opposite side of the rear panel 15 spaced from, but in line with, the first hinged tab 39. The second hinged tab also has a score 43 at the bottom thereof which extends across a portion of the rear panel 15 and the side flap 18. An embossing 44 in the rear panel 15 extends from the score 43 upwardly to the top margin 27. If desired, perforations 44 may be provided at the bottom of the front panel inwardly of the bottom margin 28 thereof to outline a small access opening 45, which may be made by the user tearing away the portion of the casing within the perforations 44 as best shown in FIG. 3.

It will be seen from an examination of FIGS. 1–3 and 5 that since the front panel 14 is wider than the rear panel 15, the shape of the dispenser package assembly will have a somewhat trapazoidal cross-section. However, it is within the purview of the present invention to use other shapes, as will be apparent to those skilled in the art.

Figure 4:
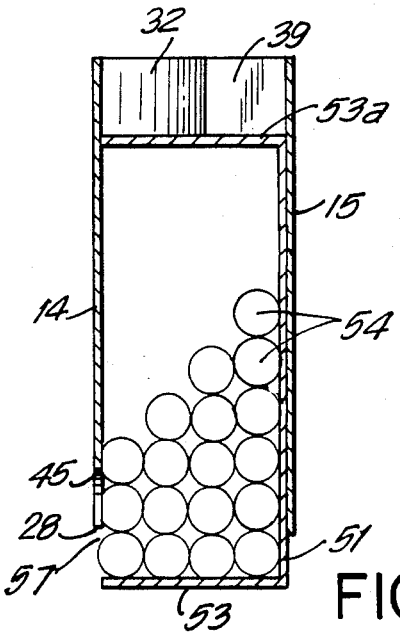
FIG. 4 is a cross-sectional view taken on line 4—4 in FIG. 3, looking in the direction of the arrows.
Figure 5:
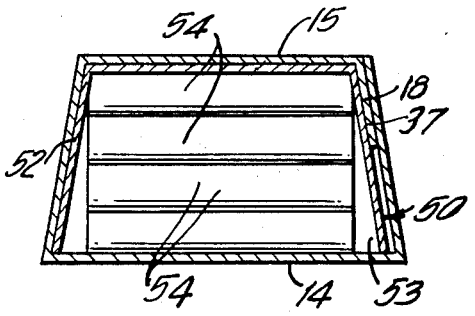
FIG. 5 is a horizontal cross-sectional view taken on line 5—5 in FIG. 3, looking in the direction of the arrows.

A tray 50, having a bottom portion 51, upstanding sides 52 and closed end portions 53, 53*a*, is slidably received within the casing 11. The articles to be carried within the packaging assembly, indicated at 54 in FIGS. 3–5, are placed within the tray 50 in the manner shown.

When the dispenser package assembly 10 is ready for sale or distribution, the tray 50 is completely within the outer casing 11 and the assembly has the appearance of a container of trapazoidal shape with closed ends.

When it is desired to place the dispenser package assembly in use, the tray is slipped a short distance out of the outer casing 11, as shown in FIG. 3. The opening 45 may be made in the front panel 14 and the rear corners 55, 56 of the outer casing, indicated in dashed lines in FIG. 2, pushed inwardly to assume the position shown in full lines in FIG. 2. This action is facilitated by the hinged connection between the side panels 16, 17 and the rear panel 15. The bottoms of the inwardly folded corners 55, 56 now act as a stop to prevent the tray 50 from moving into the outer casing 11 while the use wishes to have access to the articles 54. The articles 54 will appear in the opening 57 formed by the bottom of the tray 50 and the bottom margin 28 of the front panel 14.

If it is desired to close the dispenser package assembly, as for storing purposes, the user can snap the corners 55, 56 outward into their original position, whereupon the tray will slide completely into the outer casing 11 to fully protect the contents of the package.

It will be apparent that the dispenser package assembly 10 may be used by placing it vertically upon a support, as illustrated, or horizontally, or in a tilted position, at the convenience of the user. Moreover, once adjusted for dispensing, it is possible to have an article such as a container of medicine or an ampule appear at the opening 57 after each article is successively removed.

Having thus fully described the invention, what is desired to be claimed and secured by Letters Patent is:

1. A dispenser package assembly comprising a hollow outer casing open at each end; a top margin and a bottom margin at the open ends thereof, a tray member slidably received within the outer casing, said casing comprising a front panel, a rear panel, a first side panel and a second side panel, all interconnected along three spaced parallel fold lines extending from the top margin to the bottom margin of the casing; a side margin on the first side panel, a first hinged tab formed in one corner of the rear panel and inwardly disposed from the top margin, a second hinged tab formed in the opposite corner of the rear panel and inwardly disposed from the top margin, said tabs being swingable inwardly of the casing, opening to overlie the tray when it is not fully received within the casing, and a side flap integral with the rear panel, extending outwardly thereof and secured to the first side panel.

2. A package according to claim 1 in which the hollow outer casing is formed of a single unitary blank.

3. A package according to claim 1 in which the tray member comprises a bottom portion, spaced upstanding sides and opposed end portions.

4. A package according to claim 1 in which the area of the front panel is greater than that of the rear panel and the outer casing is substantially trapezoidal in cross-section.

5. A package according to claim 1 in which the first and second side panels are each divided into two sections by a fold line.

6. A package according to claim 5 in which the first side panel is provided with a hinged tab formed at one corner thereof between the top and side margins of the said flap and between the fold line dividing said side flap into two sections and the said side margin.

7. A package according to claim 6 in which the first hinged tab extends across the fold line between the second side panel and the rear panel and the second hinged tab extend across the fold line between the rear panel and the side flap.

* * * * *